US012687372B2

(12) United States Patent
Mentasti Granelli

(10) Patent No.: US 12,687,372 B2
(45) Date of Patent: Jul. 21, 2026

(54) THROWING WEAPON

(71) Applicant: Bruno Mentasti Granelli, Castel Veccana (IT)

(72) Inventor: Bruno Mentasti Granelli, Castel Veccana (IT)

( * ) Notice: Subject to any disclaimer, the term of this patent is extended or adjusted under 35 U.S.C. 154(b) by 169 days.

(21) Appl. No.: 18/691,143

(22) PCT Filed: Aug. 19, 2022

(86) PCT No.: PCT/IB2022/057785
§ 371 (c)(1),
(2) Date: Mar. 12, 2024

(87) PCT Pub. No.: WO2023/037183
PCT Pub. Date: Mar. 16, 2023

(65) Prior Publication Data

US 2024/0401905 A1 Dec. 5, 2024

(30) Foreign Application Priority Data

Sep. 13, 2021 (IT) ..... 102021000023546

(51) Int. Cl.
*F41B 15/00* (2006.01)

(52) U.S. Cl.
CPC ..... *F41B 15/00* (2013.01)

(58) Field of Classification Search
CPC ..... F41B 15/00; F26B 23/00
USPC ..... 30/347, 366, 303, 299, 304; 273/317
See application file for complete search history.

(56) References Cited

U.S. PATENT DOCUMENTS

| | | | | | |
|---|---|---|---|---|---|
| 970,517 | A * | 9/1910 | Lockhart | B26B 11/00 | 30/152 |
| 2,714,509 | A * | 8/1955 | Ramsey | F41B 15/00 | 273/408 |
| 4,027,389 | A * | 6/1977 | Atchisson | F41B 15/00 | 473/588 |
| 4,608,757 | A * | 9/1986 | Eckerle | B26B 27/00 | 30/162 |
| 4,807,362 | A * | 2/1989 | Prentice | F41B 15/00 | 30/155 |
| 5,344,158 | A * | 9/1994 | Gridley | F41B 15/00 | D22/115 |
| 2018/0209760 | A1* | 7/2018 | Cooper | B25G 1/00 | |
| 2021/0078189 | A1* | 3/2021 | Bin Othman | B26B 3/04 | |

* cited by examiner

*Primary Examiner* — John E Simms, Jr.
(74) *Attorney, Agent, or Firm* — FisherBroyles, LLP; Roger L. Browdy; Ronni S. Jillions

(57) ABSTRACT

A throwing weapon (100) is described as comprising: a central portion (105) mainly ex-tending along a predetermined longitudinal axis (Y), a pair of first sharp portions (130, 135), which respectively extend from the opposite axial ends (110, 115) of the central portion (105) in a direction parallel to the longitudinal axis (Y), and a pair of second sharp portions (150, 155), which protrude transversely from the central portion (105), wherein said second sharp portions (150, 155) extend from opposite parts of the central portion (105), in directions orthogonal to the longitudinal axis (Y), and are mutually off-set along the longitudinal axis (Y) itself.

1 Claim, 1 Drawing Sheet

THROWING WEAPON

TECHNICAL FIELD

The present invention relates to a throwing weapon that can be used for hunting and/or self-defence.

STATE OF THE ART

As known, a particular type of throwing weapon is represented by the so-called throwing knives, which generally comprises a single-tipped blade extending from a handle.

The thrower can thereby grasp the knife at the handle and hurl it at a distance, making it spin around itself until it sticks into the target.

However, in order for the knife to stick into the target, it must be properly oriented, i.e. the tip of the blade must be facing the target.

Any other orientation may in fact cause a more or less intense impact but will generally not penetrate the target which, in case of animals or people, will not be significantly in-jured.

It is therefore clear that, in order to use a throwing knife effectively for hunting or self-defence, the thrower is required to possess great skill.

This drawback can be overcome by using multi-tipped throwing weapons, such as the traditional Japanese "Hira Shiriken", commonly known as "ninja stars".

These are darts in the shape of a cross or star with several tips that are hurled manual-ly, transmitting to the dart, in this case as well, a rotating motion.

However, the perfectly symmetrical shape of these multi-tip stars makes them difficult to be gripped and hence thrown with force, so that the injuries that can be caused by these throwing weapons are generally minor.

DISCLOSURE OF THE INVENTION

In the light of the foregoing, an object of the present invention is to solve or at least effectively limit the aforementioned drawbacks of the prior art by making available a throwing weapon which can be used without excessive skill but which, at the same time, is capable of causing significant injuries.

These and other objects are achieved thanks to the features of the invention as set forth in the independent claim. The dependent claims outline preferred and/or particularly advantageous aspects of the invention but not strictly necessary for implementing it. In particular, an embodiment of the present invention makes available a throwing weapon comprising:

- a central portion mainly extending along a predetermined longitudinal axis,
- a pair of first sharp portions, respectively extending from the opposite axial ends of the central portion in a direction parallel to the longitudinal axis, and
- a pair of second sharp portions, which protrude transversely from the central portion, wherein said second sharp portions extend from opposite sides of the central portion, in directions orthogonal to the longitudinal axis, and are mutually off-set along the longitudinal axis itself.

Due to the presence of these four sharp portions, the throwing weapon outlined above is able to effectively stick into the target substantially at any impact orientation.

At the same time, the elongated shape and asymmetrical distribution of the second sharp portions make the weapon easier to be gripped by the thrower, who is thus able to hurl it at greater distances and with a greater force than conventional throwing weapons.

All this allows the throwing weapon of the present invention to be more effective and potentially more lethal.

According to a more specific aspect of the invention, the second sharp portions may be positioned on opposite sides relative to an (imaginary) reference plane that is orthogonal to the longitudinal axis and passing through the centreline of the central portion.

This feature emphasises the misalignment between the second sharp portions, making it easier for the thrower to grip the weapon and for the weapon to rotate while being thrown.

Another aspect of the invention is that the first sharp portions and the second sharp portions may have a planar structure, i.e. a flat, thin shape as that of a plate or slab, with a lower thickness if compared to the other dimensions.

The sharp portions can thereby cause cuts and/or wounds in the target, even if the impact does not occur exactly with one of the tips.

To increase this effect, it is also possible for the first sharp portions and/or second sharp portions to have cutting edges, substantially creating blades.

According to a further aspect of the invention, the first sharp portions may be coplanar to each other as well as coplanar to both of the second sharp portions.

The balance and aerodynamics of the throwing weapon are thereby advantageously in-creased.

Another aspect of the invention is that the central portion may also have a planar shape and be coplanar to the first and second sharp portions.

Thanks to this solution, the entire throwing weapon has a substantially planar shape, which increases its aerodynamics and therefore enables it to follow a precise trajectory with a stable attitude, increasing the accuracy of the launch.

To increase this effect, it is also possible for the central portion, the first sharp portions and the second sharp portions to have substantially the same thickness.

According to another aspect of the invention, the central portion, the first sharp portions and the second sharp portions may be made in a single body, preferably of metal material, for example but not exclusively of steel or tungsten.

This makes the throwing weapon more robust, solid and easy to manufacture, for example by simply cutting a sheet or plate of steel or other material.

A further aspect of the invention is that the distance between the tips of the second sharp portions may be between 60% and 80% of the distance between the tips of the first sharp portions.

This specific dimensional ratio provides the throwing weapon with a particularly advantageous structure, both in terms of ease of throwing and effectiveness in striking.

BRIEF DESCRIPTION OF THE DRAWINGS

Further features and advantages of the invention will be more apparent after reading the following description provided by way of a non-limiting example, with the aid of the ac-companying drawings.

DETAILED DESCRIPTION

Figure 1:
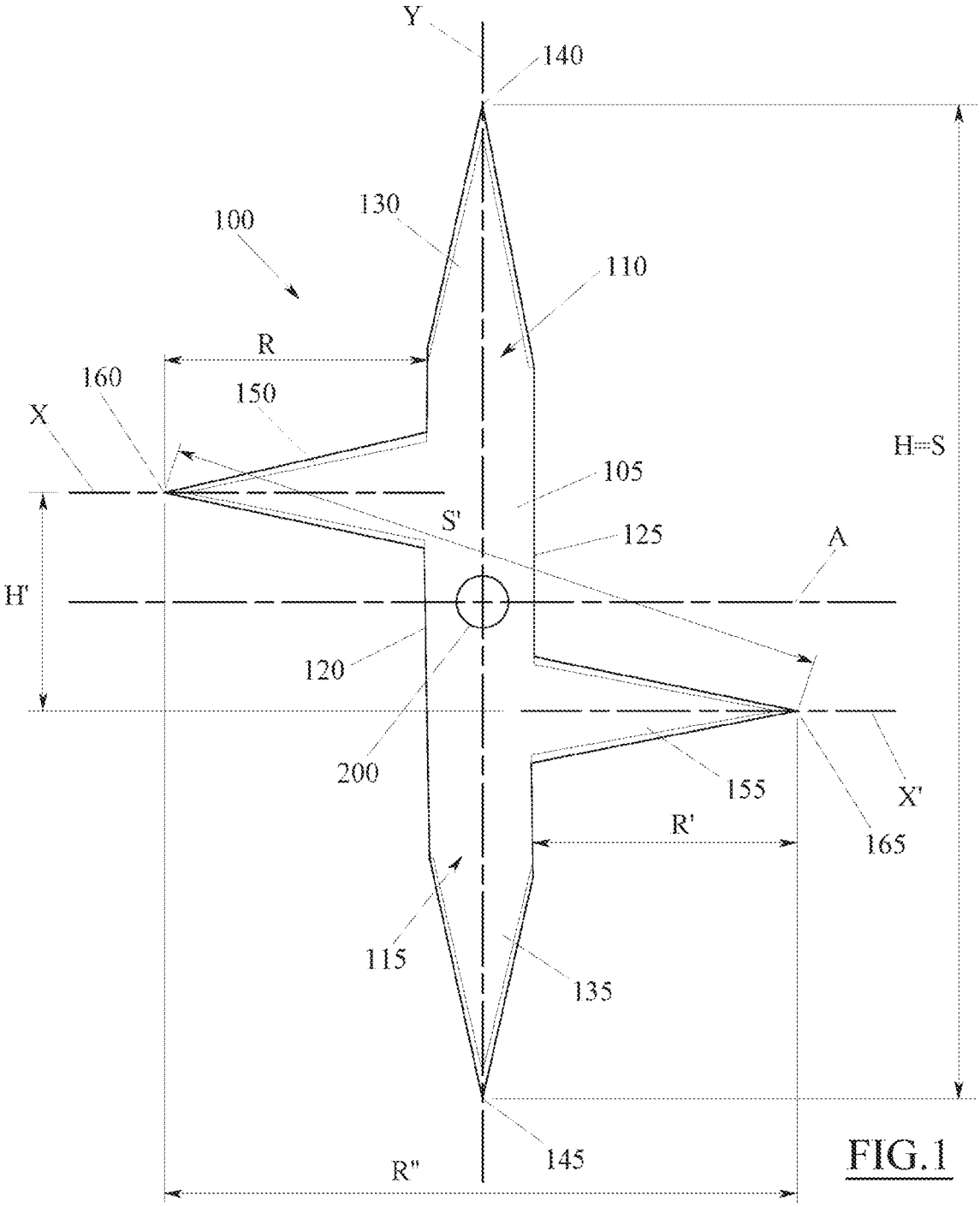
FIG. 1 is a plan view of a throwing weapon according to an embodiment of the present invention.
Figure 2:
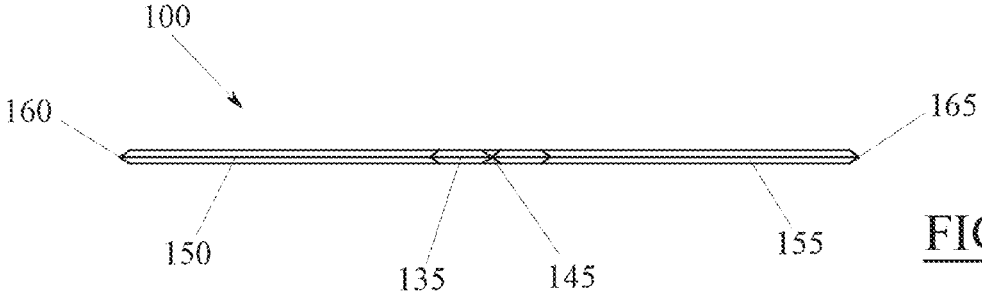
FIG. 2 is the orthogonal projection of the view in FIG. 1.

The above-mentioned figures show a throwing weapon 100, that is mainly, but not exclusively, intended to be used for hunting or self-defence.

The throwing weapon 100 comprises a central portion 105, which mainly extends along a predetermined longitudinal axis Y.

This central portion 105 may have a planar shape, i.e. flat and thin as that of a plate or slab, with one predominant dimension (length) oriented in the direction of the longitudinal axis Y, and two minor dimensions (width and thickness) oriented in mutually perpendicular directions and both orthogonal to the longitudinal axis Y.

The length of the central portion 105 is preferably greater than the width, which is in turn greater than the thickness, which may be (much) smaller than the other dimensions.

Looking at the central portion 105 along the thickness direction (as in FIG. 1), it may have a substantially rectangular shape, with two axial ends 110 and 115, mutually opposite along the longitudinal axis Y, and two side edges 120 and 125, mutually opposite and parallel to the longitudinal axis Y, wherein the axial ends 110 and 115 are generally shorter than the lateral edges 120 and 125.

The longitudinal axis Y of the central portion 105 is preferably to be intended as the axis parallel to the side edges 120 and 125 passing through the centreline of the axial ends 110 and 115.

The throwing weapon 100 further comprises a pair of sharp first portions 130 and 135, which are respectively associated with the opposite axial ends 110 and 115 of the central portion 105.

In particular, the sharp portion 130 extends from the axial end 110 by protruding, along an axis parallel to the longitudinal axis Y, from the side opposite to the axial end 115, preferably in such a way as to gradually narrow until it ends in a tip 140.

The sharp portion 130 may have a planar shape, i.e. flat and thin as that of a plate or sheet, with one dimension (length) oriented in the direction of the longitudinal axis Y, and two further dimensions (width and thickness) oriented in mutually perpendicular directions and both orthogonal to the longitudinal axis Y.

Observing the sharp portion 130 along the direction of thickness (as in FIG. 1), it may have a substantially triangular shape, for example that of an isosceles or almost isosceles triangle, the base of which is located at the axial end 110 and the opposite vertex of which defines the tip 140, which may lie along the longitudinal axis Y.

The thickness of the sharp portion 130 may be equal to the thickness of the central portion 105 and the width of the base may be equal to the distance between the side edges 120 and 125.

The length of the sharp portion 130, in this case the distance between the tip 140 and the axial end 110, may be at least slightly greater than the width of the central portion 105.

If necessary, the side edges of the sharp portion 130 can be sharpened to define cutting edges.

Similarly, the sharp portion 135 extends from the axial end 115 by protruding, along an axis parallel to the longitudinal axis Y, from the side opposite to the axial end 110, preferably in such a way as to gradually narrow until it ends in a tip 145.

The sharp portion 135 may have a planar shape, i.e. flat and thin as that of a plate or sheet, with one dimension (length) oriented in the direction of the longitudinal axis Y, and two further dimensions (width and thickness) oriented in mutually perpendicular directions and both orthogonal to the longitudinal axis Y.

Observing the sharp portion 135 along the direction of thickness (as in FIG. 1), it may have a substantially triangular shape, for example that of an isosceles or almost isosceles triangle, the base of which is located at the axial end 115, and the opposite vertex of which defines the tip 145, which may lie along the longitudinal axis Y.

The thickness of the sharp portion 135 may be equal to the thickness of the central portion 105 while the width of the base may be equal to the distance between the side edges 120 and 125.

The length of the sharp portion 135, in this case the distance between the tip 145 and the axial end 115, may be at least slightly greater than the width of the central portion 105.

If necessary, the side edges of the sharp portion 135 can be sharpened to define cutting edges.

Overall, the first above-described sharp portions 130 and 135 may be equal or nearly equal to each other, i.e. they may have substantially the same shape and size.

The first sharp portions 130 and 135 may also be mutually coplanar and, preferably, may be both coplanar with the central portion 105.

For example, the first sharp portions 130 and 135 may be arranged symmetrically or nearly symmetrically with respect to a plane of symmetry A perpendicular to the longitudinal axis Y and passing through the centreline of the central portion 105.

The throwing weapon 100 further comprises a pair of second sharp portions 150 and 155, which protrude transversely from opposite parts of the central portion 105, extending along respective axes X and X' that are mutually parallel and orthogonal to the longitudinal axis Y.

In detail, the sharp portion 150 extends from the side edge 120 protruding, along the direction of the X-axis, from the side opposite to the side edge 125, preferably in such a way as to gradually narrow until it ends in a tip 160.

Likewise, the sharp portion 150 may also have a planar shape, i.e., flat and thin as that of a plate or sheet, with one dimension (length) oriented in the direction of the axis X, one dimension (width) oriented in the direction of the longitudinal axis, and a third dimension (thickness) oriented in the direction orthogonal to both the axis X and the longitudinal axis Y.

Looking at the sharp portion 150 along the direction of thickness (as in FIG. 1), it may have a substantially triangular shape, for example that of an isosceles or nearly isosceles triangle, the base of which is located at the side edge 120 of the central portion 105, and the opposite vertex of which defines the tip 160.

The axis X can be defined as the axis perpendicular to the longitudinal axis Y and passing through the tip 160.

The thickness of the sharp portion 150 may be equal to the thickness of the central portion 105 while the width of the base is preferably less than the length of the side edge 120.

The length of the sharp portion 150, in this case the distance between the tip 160 and the side edge 120, may be at least slightly greater than the width of the base, which may be substantially equal to the width of the central portion 105.

If necessary, the side edges of the sharp portion 150 can be sharpened to define cutting edges.

Similarly, the sharp portion 155 extends from the side edge 125 protruding, along the direction of the axis X', from the side opposite to the side edge 120, preferably gradually narrowing until it ends with a tip 165.

The sharp portion 155 may have a planar shape, i.e. flat and thin as that of a plate or sheet, with one dimension (length) oriented in the direction of the axis X', one dimension (width) oriented in the direction of the longitudinal axis Y, and a third dimension (thickness) oriented in the direction orthogonal to both the longitudinal axis X' and axis Y.

Looking at the sharp portion 155 along the direction of thickness (as in FIG. 1), it may have a substantially triangular shape, for example that of an isosceles or nearly isosceles triangle, the base of which is located at the side edge 125 of the central portion 105, and the opposite vertex of which defines the tip 165.

The axis X' can be defined as the axis perpendicular to the longitudinal axis Y and passing through the tip 165.

The thickness of the sharp portion 155 may be equal to the thickness of the central portion 105 while the width of the base is lower than the length of the side edge 125.

The length of the sharp portion 155, in this case the distance between the tip 165 and the side edge 125, may be at least slightly greater than the width of the base, which may be substantially equal to the width of the central portion 105.

If necessary, the side edges of the sharp portion 155 can be sharpened to define cutting edges.

Overall, the above-described second sharp portions 150 and 155 may be equal or nearly equal to each other, i.e. they may have substantially the same shape and size.

In some embodiments, the second sharp portions 150 and 155 may also have the same shape and size (or nearly the same size) as the first sharp portions 130 and 135.

In any case, the second sharp portions 150 and 155 may be coplanar with each other and, preferably, may both be coplanar with the first sharp portions 130 and 135 and possibly with the central portion 105.

As clearly shown in FIG. 1, the second sharp portions 150 and 155 are arranged so that their respective axes X and X' are mutually offset along the longitudinal axis Y, i.e., they intersect the longitudinal axis Y at distinct tips.

In particular, it is preferable that the second sharp portions 150 and 155 are entirely positioned on opposite sides of the aforementioned plane of symmetry A.

The second sharp portion 150 is thereby closer to the first sharp portion 130, while the second sharp portion 155 is closer to the first sharp portion 135.

According to a preferred embodiment, the central portion 105, the first sharp portions 130 and 135, and the second sharp portions 150 and 155 may be made in a single body.

In other words, the throwing weapon 100 may comprise a single monolithic body, which is shaped to have the aforesaid portions.

This monolithic body can be made of metal material, such as steel or tungsten.

By way of example, the throwing weapon 100 may be obtained from a sheet or other plate of steel, which is cut according to above-described shape and shown in FIG. 1 and, if necessary, sharpened.

From a geometric point of view, some of the most representative dimensions of the throwing weapon 100 are given below.

H: distance between the tips 140 and 145 of the first sharp portions 130 and 135, along a direction parallel to the longitudinal axis Y;

H': distance between the tips 160 and 165 of the second sharp portions 150 and 155, along a direction parallel to the longitudinal axis Y;

R distance between the tip 160 of the sharp portion 150 and the side edge 120 of the central portion 105, along a direction parallel to the axis X;

R': distance between the tip 165 of the sharp portion 155 and the side edge 125 of the central portion 105, along a direction parallel to the axis X';

R": distance between the tips 160 and 165 of the second sharp portions 150 and 155, along a direction perpendicular to the longitudinal axis Y;

S: distance between the tips 140 and 145 of the first sharp portions 130 and 135 (matching, in the example shown, with the distance H);

S': distance between the tips 160 and 165 of the second sharp portions 150 and 155.

Based on these magnitudes, some of the preferred dimensional relations between the portions composing the throwing weapon 100 can be described by the following relations.

Each of the distances R and R' may be between 20% and 40% of the distance H (including the ends), preferably between 25% and 35% (including the ends).

The distance R" may be between 50% and 80% of the distance H (including the ends), preferably between 60% and 70% (including the ends).

The distance H' may be between 10% and 30% of the distance H (including the ends), preferably between 15% and 25% (including the ends).

The distance S' may be between 60% and 80% of the distance S (including the ends), preferably between 65% and 75% (including the ends).

Regardless of these size ratios, in order to get an idea of a possible actual size of the throwing weapon 100, the distance H may be considered as between 15 cm and 25 cm (including the ends), for example approximately 20 cm.

The distance H' may be approximately of 5 cm.

Each of the distances R and R' may be between 5 cm and 5.5 cm, e.g. approximately of 5.3 cm.

The distance R" may be approximately of 13 cm, while the distance S' may be close to 14 cm.

The thickness of the central portion 105, i.e., in this specific case, of the entire throwing weapon 100 (except for any sharpened edges), may be less than or equal to 3 mm, e.g., between 1.5 mm and 2.5 mm (including the ends), or substantially equal to 2 mm.

The total weight of the throwing weapon 100 may be less than or equal to 100 grams, e.g. between 60 grams and 80 grams, or approximately equal to 72 or 73 grams.

The throwing weapon 100 may finally comprise a through hole 200, which is preferably made at the centre of the central portion 105, for example with its centre coinciding with the point where the longitudinal axis Y and the plane of symmetry A intersect.

This through-hole 200 can accommodate a pin, for example fixed inside a scabbard or a case, on which one or more of the above-described throwing weapons 100 can be fit-ted, to ease transport and/or packaging for sale thereof.

Obviously, a person skilled in the art can bring about several modifications of a tech-nical-applicative nature to what described above, without thereby departing from the scope of the invention as claimed below.

The invention claimed is:

1. A throwing weapon comprising:

a central portion mainly extending along a predetermined longitudinal axis, a pair of first sharp portions, which extend respectively from the opposite axial ends of the central portion in a direction parallel to the longitudinal axis, and a pair of second sharp portions, which protrude transversely from the central portion, wherein said second sharp portions extend from opposite sides of the central portion, in directions orthogonal to the longitudinal axis, and are mutually offset along the longitudinal axis itself, wherein the first sharp portions and the second sharp portions have a planar structure, and wherein the first sharp portions and/or the second sharp portions have cutting edges.

* * * * *